US009144277B2

(12) United States Patent
Donaldson et al.

(10) Patent No.: US 9,144,277 B2
(45) Date of Patent: Sep. 29, 2015

(54) PURSE

(71) Applicants: Alison E. Donaldson, Louisville, KY (US); Abigail E. Russell, Louisville, KY (US)

(72) Inventors: Alison E. Donaldson, Louisville, KY (US); Abigail E. Russell, Louisville, KY (US)

( * ) Notice: Subject to any disclaimer, the term of this patent is extended or adjusted under 35 U.S.C. 154(b) by 243 days.

(21) Appl. No.: 13/987,355

(22) Filed: Jul. 17, 2013

(65) Prior Publication Data

US 2015/0020936 A1 Jan. 22, 2015

Related U.S. Application Data

(60) Provisional application No. 61/741,193, filed on Jul. 16, 2012.

(51) Int. Cl.
*A45C 3/00* (2006.01)
*A45C 7/00* (2006.01)

(52) U.S. Cl.
CPC ..... *A45C 7/0059* (2013.01); *A45C 2200/20* (2013.01)

(58) Field of Classification Search
CPC ..... A45C 2200/20; A45C 7/0059
USPC ..... 383/4, 38; 150/112
See application file for complete search history.

(56) References Cited

U.S. PATENT DOCUMENTS

| | | | | |
|---|---|---|---|---|
| 1,084,101 | A | | 1/1914 | Nover |
| 3,870,132 | A | | 3/1975 | Hanley |
| 4,646,804 | A | | 3/1987 | Damiano |
| 5,190,377 | A | * | 3/1993 | Kelly ..... 383/29 |
| D370,778 | S | * | 6/1996 | Sturgeon ..... D3/244 |
| D373,470 | S | * | 9/1996 | Wise ..... D3/244 |
| 5,988,879 | A | | 11/1999 | Bredderman |
| 6,047,752 | A | | 4/2000 | Southwick |
| 6,283,183 | B1 | | 9/2001 | Cooper |
| D466,290 | S | | 12/2002 | Gress |
| 6,820,664 | B1 | | 11/2004 | Ritch |
| 6,994,131 | B2 | | 2/2006 | Demon |
| D547,946 | S | * | 8/2007 | Johnson ..... D3/246 |
| 7,624,777 | B2 | | 12/2009 | Paller |
| 7,789,114 | B2 | | 9/2010 | Pape et al. |
| 2003/0121579 | A1 | | 7/2003 | Bockewitz |
| 2007/0044877 | A1 | | 3/2007 | Davidoff et al. |
| 2008/0196802 | A1 | | 8/2008 | Carlevale |
| 2008/0295931 | A1 | | 12/2008 | Meier et al. |
| 2011/0036473 | A1 | | 2/2011 | Chan et al. |

* cited by examiner

*Primary Examiner* — Tri Mai
(74) *Attorney, Agent, or Firm* — Carrithers Law Office, PLLC

(57) ABSTRACT

An expandable and collapsible purse for insulating and carrying cans or bottles or other selected items within coverable pouches or pockets formed on the inside and/or outside or the purse. The storage cavity includes pockets to store other selected items. A continuous integral cover or sleeve extends upward from the top edge which can be folded inwardly over the inner pockets and contents on the inside of the purse or folded outwardly over the outer pockets surrounding the outer surface of the purse. After the containers are stored in the pockets, the sleeve can pulled down over the inner wall pockets or over the outer wall pockets to cover and further insulate the containers. The purse preferably has a carrying strap or straps and contains a zipper, snaps or hook and loop fasteners to close the top opening when the sleeve is pulled down over the pockets.

2 Claims, 2 Drawing Sheets

PURSE

TECHNICAL FIELD

The present invention relates to expandable and collapsible purses used to carry beverage, food, medical, bottles, cosmetic and personal containers and other selected items.

BACKGROUND OF THE INVENTION

People frequently attend various public and private events and wish to carry their own cans or bottles along for personal consumption during the events. Ice chests are often used to provide a means for carrying and cooling or heating beverages. However, ice chests are large, heavy, and often require two people to carry them. The inconvenience of carrying and finding a spot to put an ice chest often prevents people from carrying beverages along to particular events. Moreover, an insulation type of fabric may be all that is necessary to maintain a desired temperature of a food item for a reasonable length of time when traveling.

For various reasons, a person may want to cover the cans or bottles. Parents carrying beverages or baby bottles often prefer that their children or others don't see the beverages within the purse. Some people consider the fact that they are carrying food or beverages with them to be a private matter and simply don't wish others to know or to see what they are carrying.

DESCRIPTION OF THE RELATED ART

U.S. Pat. No. 5,988,879 by Bredderman for FLEXIBLE STORAGE BAG issued on Nov. 23, 1999 teaches a storage bag made from flexible, insulated, water repellant, double-faced material. The bag includes a main body with an open top portion, a drawstring closure, and a divider flap to cover contents or to divide contents.

US Patent Application Publication No. 20110036473 by Chan for UTILITY TOTEBAG SYSTEM WITH MULTIPLE REPLACEABLE LINERS published on Feb. 17, 2011 teaches a bag with carrying straps comprising an outer shell and al least two interchangeable, removable liners with varying characteristics depending upon the expected use of the particular liner. For example, one liner is insulated and water proof while another is intended to hold objects which may have points such as pencils or pens and still another liner must safely hold breakable objects such as eyeglasses.

US Patent Application Publication No. 20030121579 by Bockewitz for UTILITY PURSE OR HANDBAG published on Jul. 3, 2003 teaches a purse or handbag used to carry objects which are not intended to be seen. The purse has separate side and end pouches and can have VELCRO, buttons or snaps on a side and for end surfaces to which a separate pouch or pouches are connected within the purse. One such removable pouch can hold a casino cup to be hidden from view.

SUMMARY OF THE INVENTION

The present invention comprises, consists essentially of and/or consists of an expandable and collapsible bag or purse for storing, insulating and carrying cans, bottles, cosmetics or other selected items within coverable pouches or pockets formed on the inside and outside or the purse. In the collapsed state the purse is substantially rectangular, wherein in the expanded filled state the purse has a roughly oval shaped bottom with side pockets around the periphery of the purse. The pockets are sized to hold typical beverage cans or bottles.

An ice pack or the like can be placed in the storage space surrounded by the pockets to keep the beverages cold. The storage space includes pockets to store other selected items. A cover or sleeve extends upward from the top edge of the purse and can be folded over the pockets and contents on the inside of the purse or folded over the pockets surrounding the outer surface of the purse. After the containers are stored in the pockets, the sleeve can pulled down over the inner wall pockets or over the outer wall pockets to cover and further insulate the containers. The purse preferably has a carrying strap or straps and contains a zipper, snaps or hook and loop fasteners to close the top opening left when the sleeve is pulled down over the pockets.

In accordance with the present invention, there is provided an expandable and collapsible beverage purse for storing, insulating and carrying containers such as cans and bottles consisting essentially of a bottom panel with upward extending walls connected at the marginal edges thereof. The bottom panel and the upward extending walls form an open topped container with an inner storage space and an upper marginal edge. The upward extending walls have an outer panel attached to the outer surface thereof by a plurality of vertical lateral seams and bottom seams. The upward extending wall, the outer panel, the lateral seams and the bottom seams form vertical outer pockets surround the inner storage space or cavity. The outer pockets are of a selected size for holding a container. The inner storage space is capable of holding a means for heating or cooling containers held within the outer pockets such as frozen ice packs or thermal packs. An upward extending sleeve comprises a generally cylindrical panel open at both ends. The bottom open end of the sleeve is attached by an intergral or continuous circular seam around the entire upper marginal edge of the upward extending walls. The sleeve is capable of being folded down over and covering the outer pockets and extending flush to the bottom panel. The bottom panel, the upward extending walls, the outer panel, the sleeve, the lateral seams and the bottom seam are made of flexible, waterproof, insulated material. The beverage purse is water tight. A carrying strap having two free ends is attached to at least one position on the upper marginal edge of the upward extending walls when the sleeve is pulled down over the outer pockets. The carrying strap is capable of supporting the beverage purse with beverages and the means for cooling the beverages. It is also anticipated that the sleeve could be attached to the upper marginal edge of the upward extending wall by a zipper making same removable.

The present invention provides a bag or purse for storing, insulating and carrying canned or bottled beverages and for carrying other selected items. In the expanded full state, the purse has a round or roughly oval shaped bottom with side pockets around the periphery of the purse. The pockets are sized to hold typical beverage cans or bottles. Means for cooling the containers such as an ice pack, ice cubes or the like are placed in the inner storage space surrounded by the pockets. One embodiment of the beverage purse includes a storage space containing other pockets to store other selected items. A sleeve extends upward from the top edge of the inner walls of the purse and includes a plurality of pockets formed by attaching an inner flap of material to the inner sidewall by spaced apart vertical seams. After the containers are stored in the pockets, the cover sleeve is pulled down over the outside walls of the pockets to cover and further insulate the containers. The purse preferably has a carrying strap or straps and contains a zipper, snaps, magnetic clasps, or hook and loop fasteners to close the top opening left when the sleeve is pulled down over the pockets.

It is an object of this invention to provide a beverage purse for storing, insulating and carrying containers while a user is attending public or private events.

It is an object of this invention to provide a beverage purse made of a flexible, waterproof and stylish material.

It is an object of this invention to provide a beverage purse which includes individual pockets arranged around the outside of the outer walls of the purse for removably holding containers.

It is an object of this invention to provide a beverage purse which includes an inner space surrounded by the outer wall and the pockets for holding an ice packet for chilling the beverages. The inner space is closable with a zipper, buttons, snaps, magnetic closures or hook and loop fasteners.

It is an object of this invention to provide a beverage purse having additional pockets in the inner space surrounded by the container pockets for storing additional personal items such as a wallet, keys, hair brush, and so on.

It is an object of this invention to provide a beverage purse including a removable liner capable of holding ice or a reusable 'ice pack'.

It is an object of this invention to provide a beverage purse having a sleeve extending upward from the outside walls which can be folded down over and entirely cover the beverage pockets, thus providing an extra layer of insulation and covering the pocket contents from view.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a purse for storing, insulating, covering and carrying beverages to public or private events.

The purse is constructed of a sheet of material with a coating on either or both sides to prevent leakage or the fabrication material may comprise a first sheet of vinyl material having a second sheet of a closed cell or open cell foam material held to the first sheet of vinyl material by a third sheet of vinyl or canvas or other air permeable or porous material. Other than the strap 14, the entire purse 10 is preferably made from a flexible, waterproof, strong, and insulating material.

Figure 1:
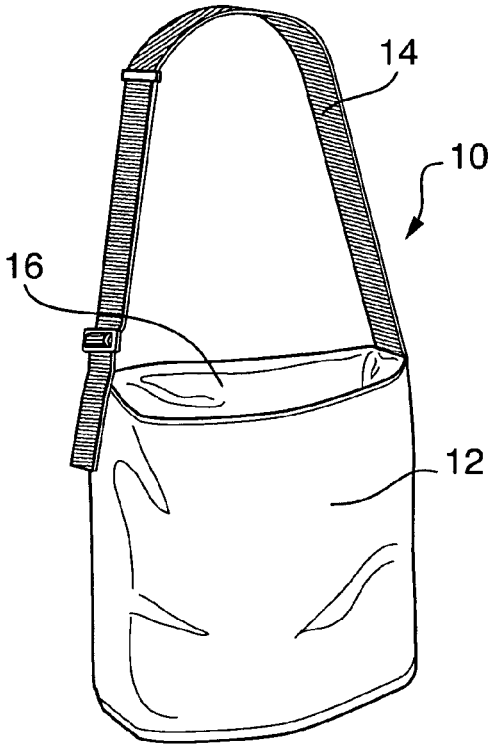
FIG. 1 is a front view of the purse.

FIG. 1 shows the purse 10 in the collapsed or empty state including an outer sleeve 12 covering the purse body, a carrying strap 14 comprised of nylon mesh or other selected material, an opening 16 to an inner cavity and a bottom surface 18. The carrying strap may include a buckle 50 or other connecting means such as a tied knot for adjusting the length of the strap.

Figure 2:
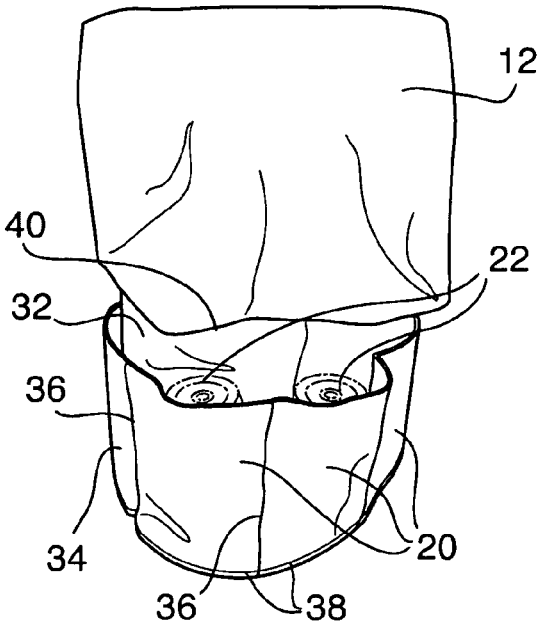
FIG. 2 is a front view of the purse with the Sleeve pulled up to expose the outer pockets.

FIG. 2 shows the purse 10 with the outer sleeve 12 attached to the top marginal edge of the wall 32 pulled or raised upward exposing a plurality of outer pockets 20 disposed around the periphery of the bag with containers 22 disposed in the outer side pockets 20. The purse body 11 is formed by a wall 32 sewn or otherwise attached to an approximately bottom panel 18 which may be generally oval, square, rectangular or round. The container pockets 20 are formed by sewing or otherwise attaching the wall 32 to an outer panel 34 along spaced apart lateral seams 36 at selected intervals and bottom seams 38 connecting to the wall 32 along the bottom panel 18.

Figure 3:
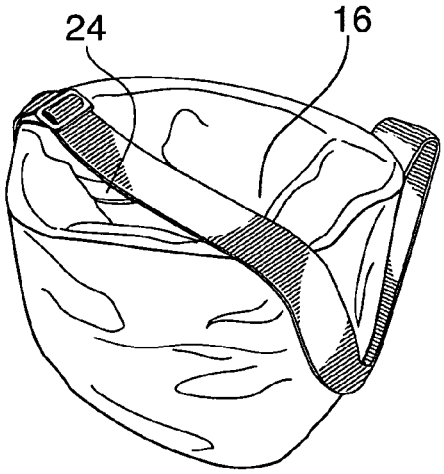
FIG. 3 is a top view of the purse showing the top opening and inner pockets.
Figure 4:
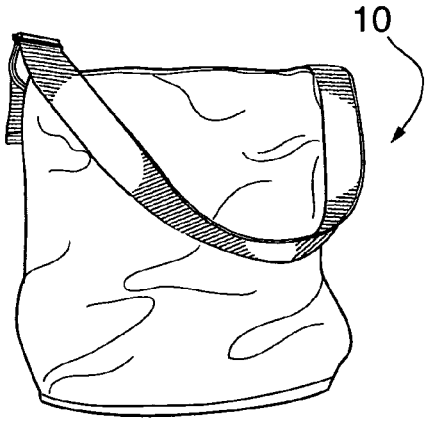
FIG. 4 is a front view of the purse with the sleeve down and covering the containers.
Figure 5:
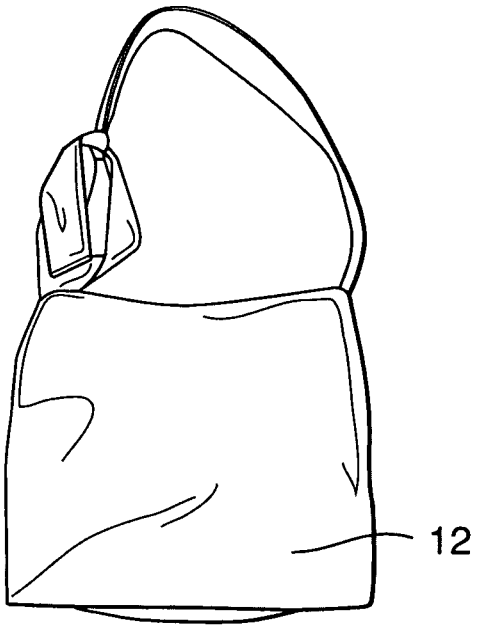
FIG. 5 is another embodiment of the purse with a closure for the top opening.
Figure 6:
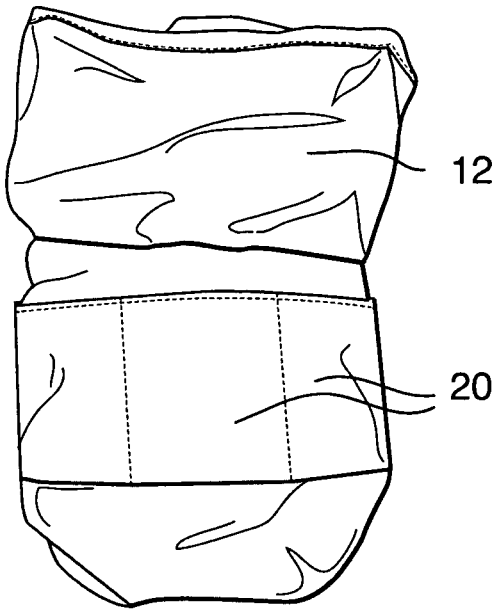
FIG. 6 is a front view of the purse with the sleeve up.

FIGS. 3 and 4 show the purse 10 in the expanded state containing containers with the cover sleeve 12 lowered down over the exterior surface of the side walls 32 to cover and further insulate the containers. The sleeve 12 comprises a tube of insulated material which is sewn or otherwise attached to the wall 32 along a seam 40 extending along the top marginal edge of the body 11. It is contemplated that the sleeve may be formed integrally with the wall 32 or attached thereto by a means of attachment such as a zipper. The inner cavity 24 of the purse shown in FIG. 3 is accessible through the opening 16.

With the sleeve 12 down in a position to cover the outer pockets as shown in FIG. 2 in the container covering position, the carrying strap 14 is attached at opposing positions on the seam 40 so that the strap 14 is covered when the sleeve 12 is in a raised position.

Figure 7:
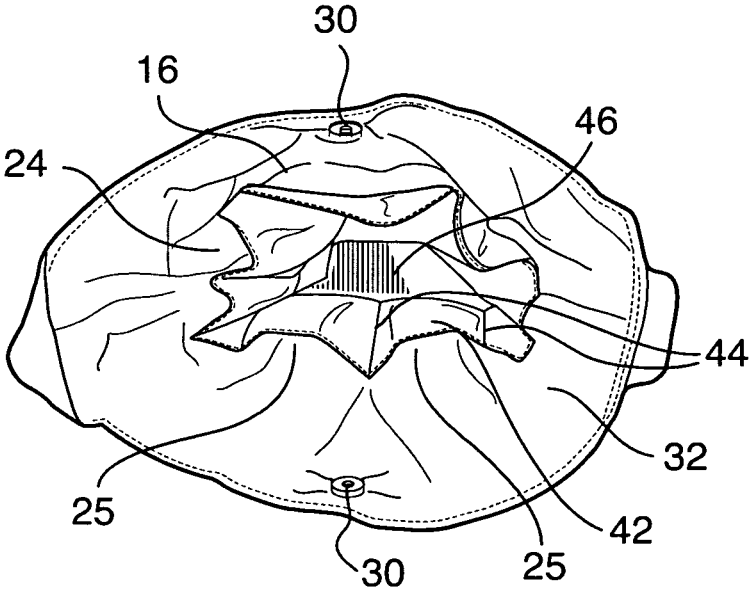
FIG. 7 is a top view looking down into the purse showing inner pockets and magnetic closures.

As best shown in FIG. 7, the inner cavity 24 is capable of holding an ice pack or other means of keeping the beverages cool or hot in inner pockets 25 formed by sewing a strip or material or panel to the interior bottom surface and interior surface of the wall 32 at the ends and selected spaced apart vertical seams. The additional inner pockets 25 formed by sewing or otherwise attaching panel 42 to the inner surface of outer wall 32 along lateral and bottom seams 44 also comprise insulated material. Panel 42 is preferably made from the same material wall 32. Inner pockets 25 are preferably used for holding items as would be carried in an ordinary purse but may also contain containers. The main inner cavity 46 is capable of holding ice packs or some other means of keeping the containers cool or hot. Holding means such as snaps 30, buttons or hook and loop fasteners may be used to hold the sidewalls 32 of the purse together for closure.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

We claim:

1. A purse for storing, insulating and carrying containers comprising:

a bottom panel with upward extending walls connected at the marginal edges thereof, said bottom panel and said upward extending walls forming an open topped container with an inner storage space and an upper marginal edge, said upward extending walls having an outer panel attached to the outer surface thereof by a plurality of vertical lateral seams and bottom seams, said upward extending wall, said outer panel, said lateral seams and said bottom seams forming vertical outer pockets, said outer pockets surrounding said inner storage space, said outer pockets sized to hold a beverage container, said inner storage space capable of holding a means for cooling containers held within said outer pockets;

an upward extending sleeve comprising a cylindrical panel open at both ends, a bottom open end of said sleeve attached by a continuous circular seam around an entire upper marginal edge of said upward extending walls, said sleeve capable of being folded down over and covering said outer pockets and extending flush to said bottom panel;

said bottom panel, said upward extending walls, said outer panel, said sleeve, said lateral seams and said bottom seam comprising flexible, waterproof, insulated material;

said purse incapable of leaking water; and a carrying strap, said carrying strap having two free ends, said two free ends of said carrying strap attached at least one position on said upper marginal edge of said upward extending walls when said sleeve is pulled down over said outer pockets, said carrying strap capable of supporting said purse with beverages and said means for cooling said beverages.

2. The purse defined in claim 1 including at least one leak proof inner pocket within said inner cavity.

* * * * *